US012325563B2

(12) United States Patent
Lou et al.

(10) Patent No.: US 12,325,563 B2
(45) Date of Patent: Jun. 10, 2025

(54) ANTI-REFILL BOTTLE CAP

(71) Applicant: SOCIETE DES PRODUITS NESTLE S.A., Vevey (CH)

(72) Inventors: Ronghe Lou, Guangdong (CN); Wenhui Xiao, Guangdong (CN); Luke Zheng, Guangdong (CN); Xiangnan He, Guangdong (CN)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 18/263,741

(22) PCT Filed: Feb. 8, 2022

(86) PCT No.: PCT/CN2022/075543

§ 371 (c)(1),
(2) Date: Aug. 1, 2023

(87) PCT Pub. No.: WO2022/171087

PCT Pub. Date: Aug. 18, 2022

(65) Prior Publication Data

US 2024/0308736 A1 Sep. 19, 2024

(30) Foreign Application Priority Data

Feb. 9, 2021 (CN) ..... 202110179356.6

(51) Int. Cl.

| | |
|---|---|
| ***B65D 49/04*** | (2006.01) |
| ***B65D 41/32*** | (2006.01) |
| ***B65D 41/34*** | (2006.01) |
| *B65D 51/18* | (2006.01) |

(52) U.S. Cl.

CPC ..... *B65D 49/04* (2013.01); *B65D 41/325* (2013.01); *B65D 41/3447* (2013.01); *B65D 51/18* (2013.01); *B65D 2401/15* (2020.05)

(58) Field of Classification Search

CPC ..... B65D 49/04; B65D 49/02; B65D 49/00; B65D 51/18; B65D 41/325; B65D 41/32; B65D 41/3447; B65D 41/3442; B65D 2401/40; B65D 2401/15

USPC ..... 215/14, 254, 253, 250; 220/202, 203.29, 220/203.01, 266, 265

See application file for complete search history.

(56) References Cited

FOREIGN PATENT DOCUMENTS

GB 2302867 2/1997

*Primary Examiner* — Robert J Hicks
(74) *Attorney, Agent, or Firm* — K&L Gates LLP

(57) ABSTRACT

A separate bottle cap comprising a bottle body connector (1), an outer cap (2), an anti-backflow assembly (3) and an inner cap (4), wherein the bottle body connector (1) is a hollow cylinder, a lower end thereof is fit and connected to a bottle body, the anti-backflow assembly (3) is provided between the bottle body connector (1) and the inner cap (4), a lower end of the outer cap (2) is sleeved on the anti-backflow assembly (3) and locks an inner wall of the bottle body connector (1), and the outer cap (2) is provided on the inner cap (4), wherein the anti-backflow assembly (3) comprises a piston anti-backflow water blocking member (31) and a water sealing connector (32), and the piston anti-backflow water blocking member (31) is movably connected with the water scaling connector (32).

14 Claims, 4 Drawing Sheets

ANTI-REFILL BOTTLE CAP

CROSS REFERENCE TO RELATED APPLICATIONS

The present application is a National Stage of International Application No. PCT/CN2022/075543, filed on Feb. 8, 2022, which claims priority to China Patent Application No. 202110179356.6, filed on Feb. 9, 2021, the entire contents of which are being incorporated herein by reference.

TECHNICAL FIELD

The present application relates to a bottle cap, in particular to a separate bottle cap and package using the same.

BACKGROUND

Bottle cap is an important part of food and beverage packages, and it is also the first place for consumers to contact with products. Bottle cap has the function of keeping the tightness of packaged products, and also has the function of realizing anti-theft opening and safety. With the changing needs of consumers and the market, anti-theft and anti-backflow bottle caps have become the first choice for food and beverage production and packaging.

SUMMARY

The main purpose of the present application is to provide a separate bottle cap and a package using the same, so that the package of food and beverage has anti-theft and anti-backflow functions.

In order to realize the purpose, the present application adopts the following technical solution:

The present application provides a separate bottle cap, which includes a bottle body connector, an outer cap, an anti-backflow assembly and an inner cap, the bottle body connector is a hollow cylinder, a lower end of the bottle body connector is fit and connected with a bottle body, the anti-backflow assembly is provided between the bottle body connector and the inner cap, a lower end of the outer cap is sleeved on the anti-backflow assembly and locks an inner wall of the bottle body connector, and the outer cap is provided on the inner cap.

In some embodiments, the anti-backflow assembly includes a piston anti-backflow water blocking member and a water sealing connector, and the piston anti-backflow water blocking member is movably connected with the water sealing connector.

In some embodiments, the piston anti-backflow water blocking member is a hat shape with a brim, and an annular retaining wall is formed on a brim of an outer wall of the piston anti-backflow water blocking member.

In some embodiments, a lower end of an inner wall of the piston anti-backflow water blocking member is formed as a conical structure.

In some embodiments, a fluid passage is provided in the water sealing connector, a cross three-dimensional bump is formed in the fluid passage, a notch is provided in the middle of the cross three-dimensional bump, the notch makes an upper end of the cross three-dimensional bump formed as four cuboid columns, and the piston anti-backflow water blocking member adaptively covers the four cuboid columns.

In some embodiments, the diameter of the part from the piston anti-backflow water blocking member to the annular retaining wall is adapted to the diameter of the fluid passage.

In some embodiments, an annular platform is formed on an upper portion of the water sealing connector against the inner wall of the bottle body connector.

In some embodiments, a bottom end of the inner cap rests against the annular platform of the water sealing connector.

In some embodiments, the inner cap forms a cap body matching the shape of the piston anti-backflow water blocking, and the cap body is provided right above the piston anti-backflow water blocking member.

In some embodiments, an annular retaining wall is further formed on an outer wall of the cap body.

In some embodiments, the inner cap is further provided with a fluid passage, and the fluid passage is formed around the cap body.

In some embodiments, a fluid guide port is provided in a top end of the fluid passage, and the fluid guide port is provided as a beveled guide port or a filleted guide port.

In some embodiments, a bottom end of the inner cap is provided with a snap ring, an upper end of the inner wall of the bottle body connector is provided with a snap groove matching the snap ring, the inner cap and the bottle body connector are locked and connected with the snap groove through the snap ring, and a bottom end of the snap ring is just butted against an upper surface of the annular platform.

In some embodiments, a bottom end of the outer cap is further provided with an anti-theft ring, an inner wall of the anti-theft ring is provided with a snap buckle, an outer wall of an upper end of the bottle body connector is provided with an annular snap position matching the snap buckle, the anti-theft ring is locked and connected with the bottle body connector before unsealing, and the anti-theft ring is separated from the bottle body connector after unsealing.

In some embodiments, a hollow ring body is formed on an inner wall of a top end of the outer cap, the diameter of the hollow ring body is consistent with the diameter of the inner wall of the inner cap, and the hollow ring body is adaptively locked on an inner wall of the fluid passage.

The present application further provides a package, which includes the separate bottle cap.

By adopting the above technical solution, the inner cap, the piston anti-backflow water blocking member and the water sealing connector of the present application are assembled, and the piston anti-backflow water blocking member is disposed in a cavity formed by the inner cap and the water sealing connector, thus controlling the moving range of the piston anti-backflow water blocking member, improving the clamping efficiency and accuracy of the piston anti-backflow water blocking member, and making its anti-backflow effect better. When a fluid is poured out, the opening range of the piston anti-backflow water blocking member is also controlled, thus limiting the excess flow of the fluid. In addition, when the package is shaken, the sound of the piston anti-backflow water blocking member is small. After unsealing, an anti-theft ring is separated from the bottle body connector, but the anti-theft ring is still fixedly connected with the outer cap, which provides a new anti-theft design method.

DESCRIPTION OF THE EMBODIMENTS

Figure 1:
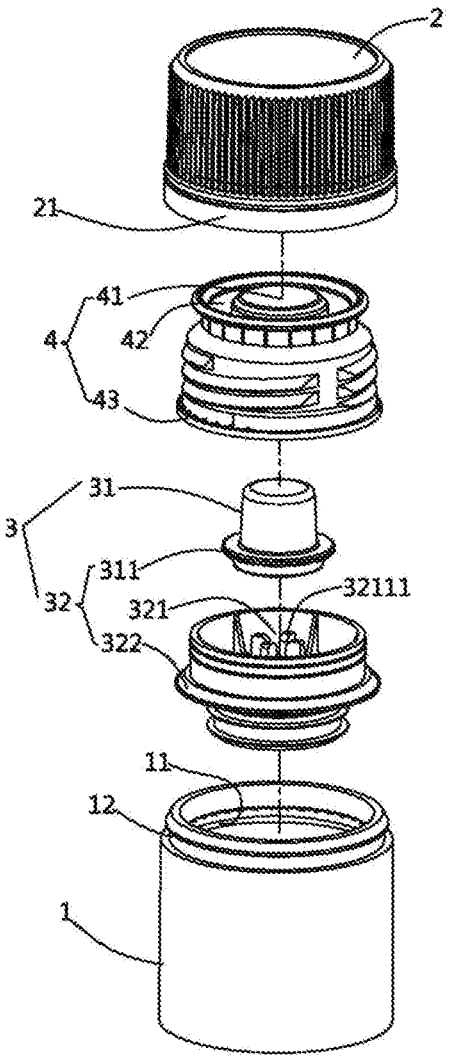
FIG. 1 is an exploded view according to the present application.

In order to make the purpose, technical solution and advantages of the present application more clear, the present application will be further described in detail below in combination with the embodiments with reference to the drawings. It should be understood that the specific embodiments described herein are only used for describing, instead of limiting the present application.

In the description of the present application, it should be noted that, unless otherwise clearly specified and limited, the terms "mounting", "connected" and "connection" should be understood in a broad sense. For example, it may be fixed connection, removable connection, or integrated connection; it may be mechanical connection or electrical connection; it may be direction connection or indirect connection through an intermediate medium. For those skilled in the art, the specific meanings of the above terms in the present application may be understood in specific circumstances.

Embodiment 1

Referring to FIG. 1 to FIG. 5, the present application provides a separate bottle cap, which includes a bottle body connector 1, an outer cap 2, an anti-backflow assembly 3 and an inner cap 4.

In this embodiment, the bottle body connector 1 is a hollow cylinder, a lower end of the bottle body connector 1 is fit and connected with a bottle body, the anti-backflow assembly 3 is provided between the bottle body connector 1 and the inner cap 4, a lower end of the outer cap 2 is sleeved on the anti-backflow assembly 3 and locks an inner wall of the bottle body connector 1, and the outer cap 2 is provided on the inner cap 4.

Herein, an upper end of an outer wall of the bottle body connector 1 is provided with an annular snap position 12, and an inner wall is provided with a snap groove 11.

A bottom end of the outer cap 2 is provided with an anti-theft ring 21, and a hollow ring body 22 is further formed on an inner wall of a top end of the outer cap 2.

The anti-backflow assembly 3 includes a piston anti-backflow water blocking member 31 and a water sealing connector 32.

The piston anti-backflow water blocking member 31 is a hat shape with a brim, an annular retaining wall 311 is formed on a brim of an outer wall of the piston anti-backflow water blocking member 31, and an inner wall of the piston anti-backflow water blocking member 31 is formed as a cone.

Figure 4:
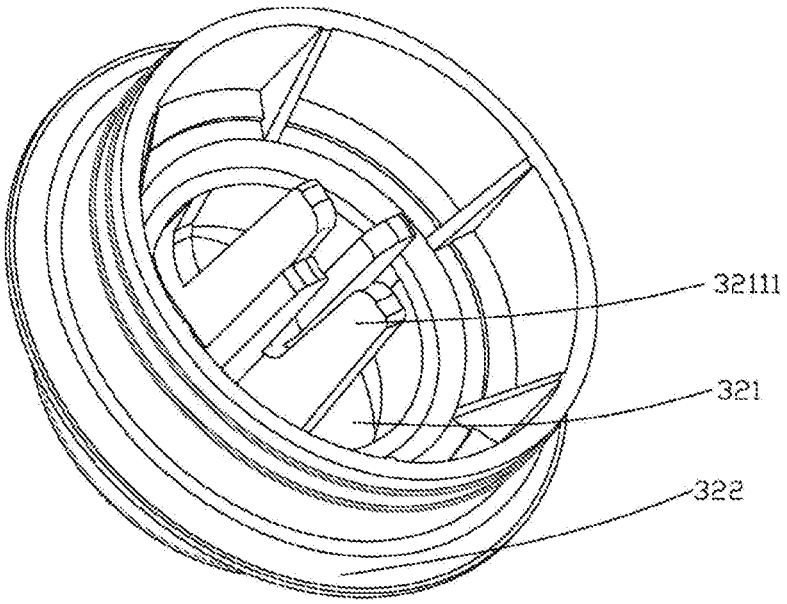
FIG. 4 is a view of a water sealing connector according to the present application.
Figure 5:
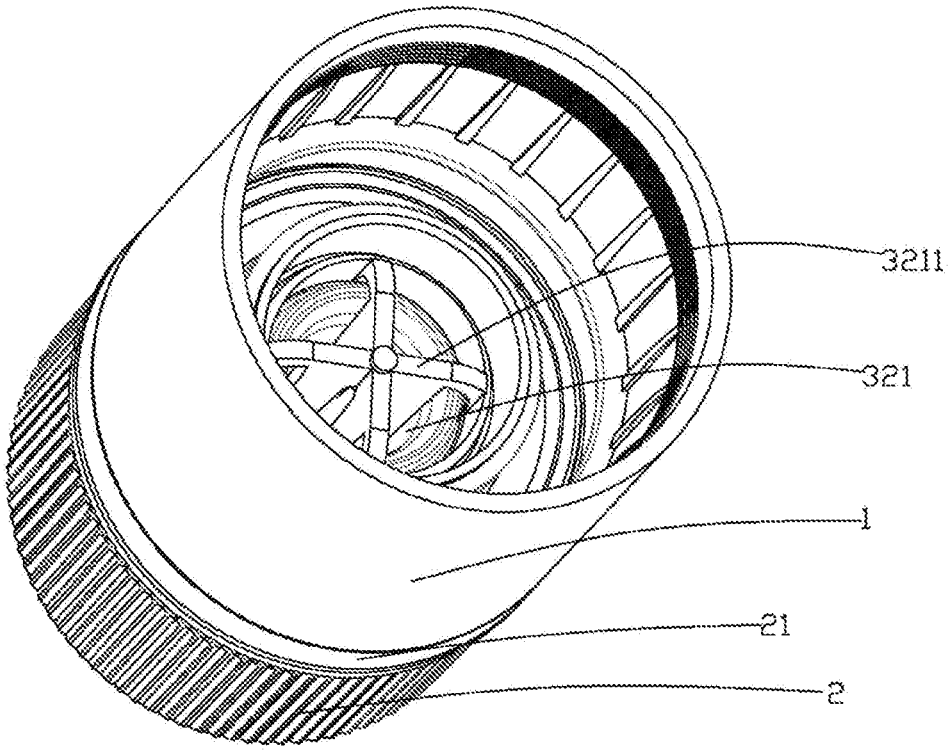
FIG. 5 is a three-dimensional view according to the present application.

Referring to FIG. 4 and FIG. 5, a fluid passage 321 is provided in the water scaling connector 32, a cross three-dimensional bump 3211 is formed in the fluid passage 321, a notch is provided in the middle of the bump 3211, the notch makes an upper end of the cross three-dimensional bump 3211 formed as four cuboid columns 32111, and the piston anti-backflow water blocking member 31 adaptively covers the four cuboid columns 32111. The existence of the notch can also make the fluid contained into the notch rush away from the anti-backflow water blocking member 31 covering it. At the same time, the notch is formed as four cuboid columns 32111, which is conducive to the adjustment of thermal expansion and cold contraction, so that the anti-backflow water blocking member 31 covering it will not be stuck due to thermal expansion. The four cuboid columns 32111 also provide positioning and guidance for the anti-backflow water blocking member 31, so that the anti-backflow water blocking member 31 does not move freely or deviate from its position. The above design improves the movement stability of the anti-backflow water blocking member 31.

Referring to FIG. 1, the inner cap 4 forms a cap body 41, and the inner cap 4 is provided with a fluid passage 42 and a snap ring 43. An annular retaining wall 411 is further formed on an outer wall of the cap body 41. A top end of the fluid passage 42 is provided with a fluid guide port, which is a beveled guide port or a filleted guide port.

Figure 2:
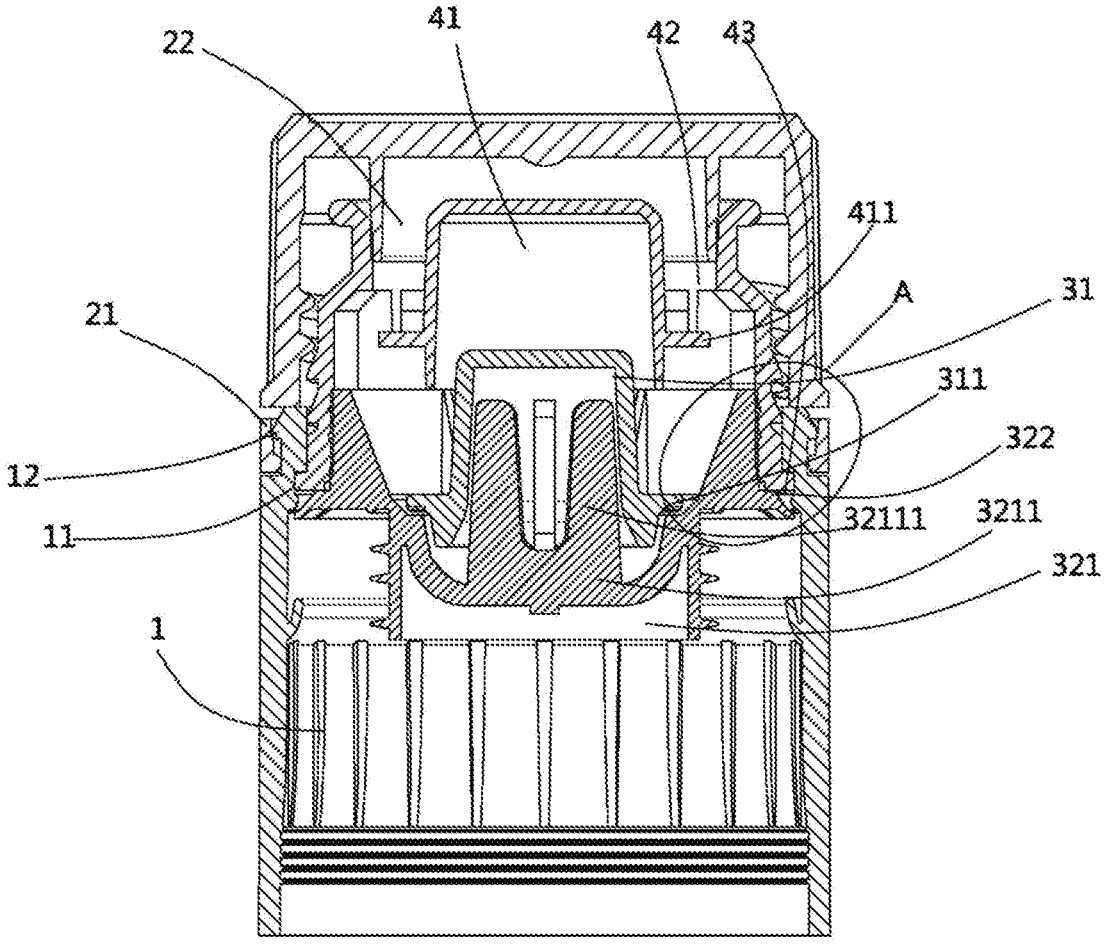
FIG. 2 is cross-sectional view according to the present application.
Figure 3:
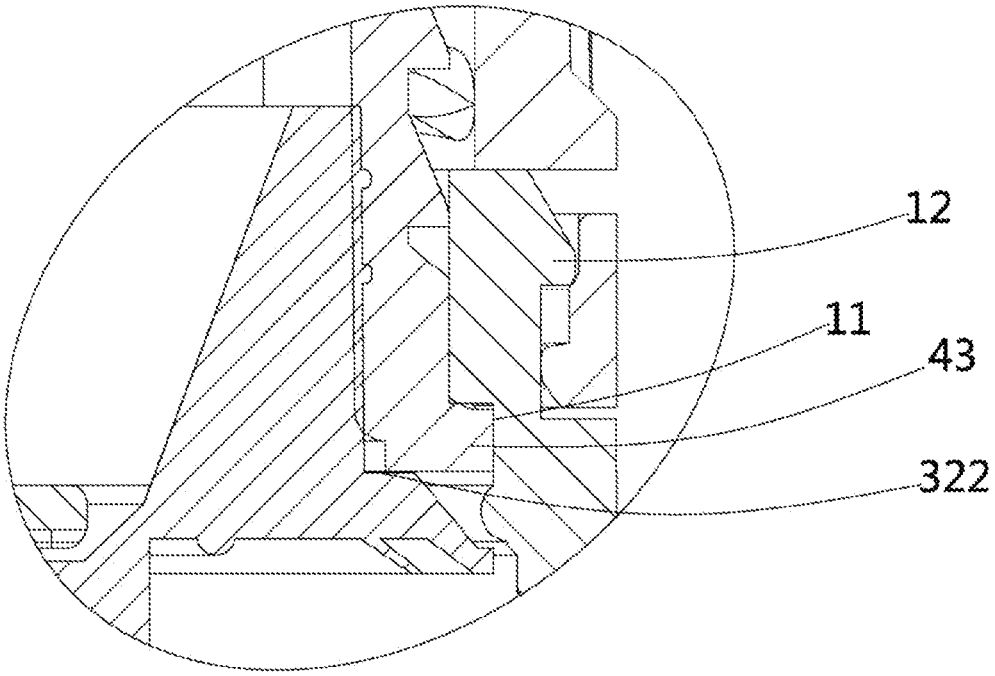
FIG. 3 is an enlarged view of a local position A of a cross section according to the present application.

Referring to FIG. 1, FIG. 2 and FIG. 3, in this embodiment, assembling steps are as follows:

In step 1, the cone of the inner wall of the anti-backflow water blocking member 31 completely downwards covers the four cuboid columns 32111 in a manner of adapting to the size. The annular retaining wall 311 on the brim of the outer wall of the downward piston anti-backflow water blocking member 31 coincides with the inner wall of the cross three-dimensional bump 3211 of the fluid passage 321 in the water sealing connector 32 to block the downward flow of the fluid through the fluid passage 321 to form a blocked state. The inner cap 4 is placed on the water sealing connector 32. The bottom end of the snap ring 43 of the inner cap 4 is just butted against the outer wall of the annular platform 322 of the water sealing connector 32.

The inner cap 4, the anti-backflow water blocking member 31 and the water sealing connector 32 are assembled to form an assembly. The cap body 41 of the inner cap 4 is provided right above the anti-backflow water blocking member 31. The diameter of the cap body 41 is slightly larger than the diameter of the upper half of the anti-backflow water blocking member 31. The anti-backflow water blocking member 31 may be movably sleeved into the cap body 41.

In step 2, the assembly 1 formed by the assembling the inner cap 4, the anti-backflow water blocking member 31 and the water sealing connector 32 is assembled with the bottle body connector 1. The assembly is pressed hard to make the thread formed on the outer wall of the lower half of the water sealing connector 32 lock the bottle body, and simultaneously make the snap ring 43 at the bottom end of the inner cap 4 lock the snap groove 11 in the inner wall of the bottle body connector 1.

The snap ring 43 is butted against the water sealing connector 32, and the water sealing connector 32 locks the bottle body connector 1, so that the inner cap 4, the anti-backflow water blocking member 31, the water sealing connector 32 and the bottle body connector 1 are ingeniously assembled to form an assembly 2.

In step 3, the outer cap 2 is assembled on the assembly 2 by means of capping machine or hard pressing. The inner wall of the anti-theft ring 21 at the bottom end of the outer cap 2 is provided with a snap buckle. When pressed hard, the snap buckle is locked into the annular snap position 12 at the upper end of the outer wall of the bottle body connector 1 of the assembly 2. At the same time, the hollow ring body 22 on the inner wall at the top end of the outer cap 2 is locked into the inner wall of the fluid passage 42 of the inner cap 4. The hollow ring body 22 guides the fluid from the fluid passage 42 into the outer cap, thus improving the tightness of the bottle cap.

Figure 6:
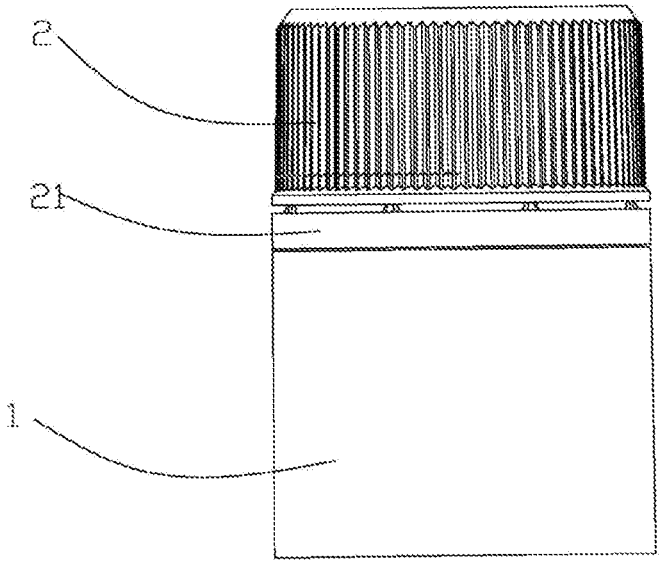
FIG. 6 is a view after completion of assembling according to the present application.

After these three steps, referring to FIG. 6, the assembling of the separate bottle cap is completed.

When the fluid is guided out, the outer cap 2 is held and twisted clockwise to disconnect easy-to-break teeth connected between the bottle body connector 1 and the anti-theft ring 21. At the same time, the snap buckle of the outer cap is separated from the annular snap position 12 of the bottle body connector 1. After twisting, the anti-theft ring 21 is still connected with the outer cap 2. This design not only achieves the anti-theft effect, but also provides a new anti-theft design for packages.

Then, the separate bottle cap is inverted, the fluid passage 42 of the inner cap 4 is communicated with the fluid passage 321 of the water sealing connector 32, and the fluid flows out of the bottle body connector 1, which is a hollow cylinder, and enters the fluid passage 321 of the water sealing connector 32.

When the separate bottle cap is inverted, the anti-backflow water blocking member 31 slides into the cap body 41 of the inner cap 4 along the four cuboid columns 32111, the anti-backflow water blocking member 31 leaves the inner wall of the cross three-dimensional bump 3211 of the fluid passage 321, the blocked or clogged fluid passage 321 is opened, part of the fluid rushes into the hat of the anti-backflow water blocking member 31, and the inner wall of the anti-backflow water blocking member 31 makes the fluid flow smoothly and flow out from the bottom end of the wide-opening cone.

Most of the fluid in the fluid passage 321 directly enters the inner cap 4. The fluid passage 42 of the inner cap 4 is formed around the cap body 41. When the fluid enters around the cap body 41, the annular retaining wall 411 formed on the outer wall of the cap body 41 blocks the fluid, changes the flow direction of the fluid, and makes the fluid flow along a direction closer to the inner of the inner cap 4, so that the fluid is guided out slowly and evenly against the inner wall of the inner cap 4.

The top end of the fluid passage 42 of the inner cap 4 is provided with a fluid guide port. The fluid guide port may be provided as a beveled guide port or a filleted guide port. The best choice is a beveled guide port, which has better fluid collection effect and can prevent the fluid from easily overflowing.

When the fluid is poured or filled from the fluid passage 42 of the inner cap 4, the fluid guide port is upward, the separate bottle cap is upward on the whole, the anti-backflow water blocking member 31 moves downward from the cap body 41 and completely covers the four cuboid columns 32111, the anti-backflow water blocking member 31 coincides with the inner wall of the cross three-dimensional bump 3211 of the fluid passage 321, and the fluid passage 321 forms a blocked state, and the poured or filled fluid is blocked on the brim of the anti-backflow water blocking member 31, thus realizing the anti-backflow function.

The separate bottle cap is made of one or a combination of HPDE, PE, PP, PS materials or other new materials suitable for food or beverage. The colors of the bottle body connector 1, the outer cap 2, the anti-backflow assembly 3 and the inner cap 4 may be designed and matched into a combination of various colors or a pure color.

Embodiment 2

The present application further provides a package, which includes the separate bottle cap provided in Embodiment 1.

The above content is a further detailed description of the present application in combination with the specific embodiments. It should not be understood as that the specific implementation of the present application is limited to these descriptions. For ordinary technicians in the technical field to which the present application belongs, several simple deductions or replacements may be made without departing from the concept of the present application, which shall all be deemed as included in the scope of protection of the present application.

The invention claimed is:

1. A separate bottle cap comprising a bottle body connector, an outer cap, an anti-backflow assembly and an inner cap, wherein the bottle body connector is a hollow cylinder, a lower end thereof is fit and connected to a bottle body, the anti-backflow assembly is provided between the bottle body connector and the inner cap, a lower end of the outer cap is sleeved on the anti-backflow assembly and locks an inner wall of the bottle body connector, and the outer cap is provided on the inner cap; wherein:

the anti-backflow assembly comprises a piston anti-backflow water blocking member and a water sealing connector, and the piston anti-backflow water blocking member is movably connected with the water sealing connector, a fluid passage is provided in the water sealing connector, and a cross three-dimensional bump is formed by the fluid passage and a piston anti-backflow water blocking member is configured to adaptively cover the cross-three dimensional bump.

2. The separate bottle cap according to claim 1, wherein the piston anti-backflow water blocking member is a hat shape with a brim, and an annular retaining wall is formed on the brim of an outer wall of the piston anti-backflow water blocking member.

3. The separate bottle cap according to claim 1, wherein a lower end of an inner wall of the piston anti-backflow water blocking member is formed as a conical structure.

4. The separate bottle cap according to claim 2, wherein a notch is provided in a middle of the cross three-dimensional bump, the notch makes an upper end of the cross three-dimensional bump formed as four cuboid columns, and the piston anti-backflow water blocking member adaptively covers the four cuboid columns.

5. The separate bottle cap according to claim 2, wherein a diameter of a part from the piston anti-backflow water blocking member to the annular retaining wall is adapted to a diameter of the fluid passage.

6. The separate bottle cap according to claim 4, wherein an annular platform is formed on an upper portion of the water sealing connector against the inner wall of the bottle body connector.

7. The separate bottle cap according to claim 1, wherein a bottom end of the inner cap rests against an annular platform of the water sealing connector.

8. The separate bottle cap according to claim 1, wherein the inner cap forms a cap body matching a shape of the piston anti-backflow water blocking member, and the cap body is provided right above the piston anti-backflow water blocking member.

9. The separate bottle cap according to claim 8, wherein an annular retaining wall is further formed on an outer wall of the cap body.

10. The separate bottle cap according to claim 8, wherein the inner cap is further provided with a further fluid passage, and the fluid passage is formed around the cap body.

11. The separate bottle cap according to claim 10, wherein a fluid guide port is provided in a top end of the further fluid passage, and the fluid guide port is provided as a beveled guide port or a filleted guide port.

12. The separate bottle cap according to claim 10, wherein a bottom end of the inner cap is provided with a snap ring, an upper end of the inner wall of the bottle body connector is provided with a snap groove matching the snap ring, the inner cap and the bottle body connector are locked and connected with the snap groove through the snap ring, and a bottom end of the snap ring is just butted against an upper surface of an annular platform.

13. The separate bottle cap according to claim 1, wherein a bottom end of the outer cap is further provided with an anti-theft ring, an inner wall of the anti-theft ring is provided with a snap buckle, an outer wall of an upper end of the bottle body connector is provided with an annular snap position matching the snap buckle, the anti-theft ring is locked and connected with the bottle body connector before unsealing, and the anti-theft ring is separated from the bottle body connector after unsealing.

14. The separate bottle cap according to claim 13, wherein a hollow ring body is formed on an inner wall of a top end of the outer cap, a diameter of the hollow ring body is consistent with a diameter of the inner wall of the inner cap, and the hollow ring body is adaptively locked on an inner wall of the fluid passage.

* * * * *